US007728771B2

(12) United States Patent
Lee et al.

(10) Patent No.: US 7,728,771 B2
(45) Date of Patent: Jun. 1, 2010

(54) DUAL BAND QUADPACK TRANSMIT/RECEIVE MODULE

(75) Inventors: Michael J. Lee, Ellicott City, MD (US); Eric V. Miller, Phoenix, MD (US); Joseph A. Faulkner, Ellicott City, MD (US); Cynthia W. Berry, Pasadena, MD (US); Gene A. Digennaro, Dundalk, MD (US); Kerron R. Duncan, Randallstown, MD (US); Ronald G. Freitag, Catonsville, MD (US); Tapan K. Gupta, Ellicott City, MD (US); Harry V. Guy, III, Westminster, MD (US); Vincent G. Karasack, Ellicott City, MD (US); Dave M. Krafcsik, Crownsville, MD (US); Brian T. McMonagle, Ellicott City, MD (US); Robert B. Middleton, Laurel, MD (US); Benjamin R. Myers, Columbia, MD (US); Mike L. Salib, Millersville, MD (US); John P. Vitamvas, Columbia, MD (US); Thomas M. Walsh, Bowie, MD (US); Eric D. Zirofsky, Washington, DC (US); John W. Gipprich, Millersville, MD (US)

(73) Assignee: Northrop Grumman Systems Corporation, Los Angeles, CA (US)

( * ) Notice: Subject to any disclaimer, the term of this patent is extended or adjusted under 35 U.S.C. 154(b) by 166 days.

(21) Appl. No.: 11/773,105

(22) Filed: Jul. 3, 2007

(65) Prior Publication Data

US 2009/0009390 A1 Jan. 8, 2009

(51) Int. Cl.
*H01Q 3/36* (2006.01)

(52) U.S. Cl. ..... 342/368

(58) Field of Classification Search ..... 342/81, 342/368–377, 29–40, 63–65; 343/700 MS, 343/850–865; 455/269–294
See application file for complete search history.

(56) References Cited

U.S. PATENT DOCUMENTS 4,173,386 A 11/1979 Kauffman et al.

(Continued)

OTHER PUBLICATIONS

Design of a two stage Low Noise Amplifier at Ku Band Abbas, T.; Bin Ihsan, M.; Microelectronics, 2005. ICM 2005. The 17th International Conference on Dec. 13-15, 2005 pp. 40-45 Digital Object Identifier 10.1109/ICM.2005.1590033.*

(Continued)

*Primary Examiner*—Thomas H Tarcza
*Assistant Examiner*—Cassi Galt
(74) *Attorney, Agent, or Firm*—Rothwell, Figg, Ernst & Manbeck, P.C.

(57) ABSTRACT

A multi-channel, dual-band, radio frequency (RF) transmit/receive (T/R) module, for an active electronically scanned array, is provided. The module includes a compact, RF manifold connector and at least four T/R channels. Each of the T/R channels includes a notch radiator, a diplexer coupled to the notch radiator, a power amplifier, including at least one dual-band gain stage, coupled to the notch radiator, a low noise amplifier, including at least one lower-band gain stage and at least one upper-band gain stage, coupled to the diplexer, and a T/R cell, including a phase shifter, a signal attenuator and at least one dual-band gain stage, coupled to the power amplifier, the low noise amplifier and the manifold connector.

22 Claims, 9 Drawing Sheets

U.S. PATENT DOCUMENTS

| | | | | |
|---|---|---|---|---|
| 4,301,457 | A | | 11/1981 | Bogner |
| 4,951,060 | A | * | 8/1990 | Cohn ..... 342/175 |
| 5,175,560 | A | | 12/1992 | Lucas et al. |
| 5,493,308 | A | | 2/1996 | Bingham et al. |
| 5,688,618 | A | | 11/1997 | Hulderman et al. |
| 5,745,076 | A | | 4/1998 | Turlington et al. |
| 5,940,031 | A | | 8/1999 | Turlington et al. |
| 6,034,633 | A | | 3/2000 | Cassen et al. |
| 6,094,161 | A | | 7/2000 | Cassen et al. |
| 6,097,335 | A | | 8/2000 | Cassen et al. |
| 6,114,986 | A | | 9/2000 | Cassen et al. |
| 6,278,400 | B1 | | 8/2001 | Cassen et al. |
| 6,414,631 | B1 | | 7/2002 | Fujimoto |
| 6,483,481 | B1 | | 11/2002 | Sievenpiper et al. |
| 6,556,168 | B1 | | 4/2003 | Marumoto et al. |
| 6,686,875 | B1 | | 2/2004 | Wolfson et al. |
| 6,750,804 | B2 | | 6/2004 | Chen et al. |
| 6,801,160 | B2 | | 10/2004 | Henderson et al. |
| 6,828,932 | B1 | | 12/2004 | Jenabi |
| 6,850,204 | B1 | | 2/2005 | Angelucci |
| 6,876,846 | B2 | | 4/2005 | Tamaki et al. |
| 6,885,563 | B2 | | 4/2005 | Panella et al. |
| 6,890,511 | B2 | | 5/2005 | Rohde et al. |
| 7,076,216 | B2 | * | 7/2006 | Hayashi ..... 455/78 |
| 7,161,537 | B2 | * | 1/2007 | Rafi et al. ..... 343/700 MS |
| 2002/0167449 | A1 | | 11/2002 | Frazita et al. |
| 2002/0190891 | A1 | | 12/2002 | Viana et al. |
| 2004/0150554 | A1 | | 8/2004 | Stenger et al. |
| 2004/0178959 | A1 | | 9/2004 | Park |
| 2004/0233099 | A1 | | 11/2004 | Jenabi |
| 2004/0263378 | A1 | | 12/2004 | Jossef et al. |
| 2004/0266384 | A1 | | 12/2004 | Davis |
| 2005/0026647 | A1 | | 2/2005 | Li et al. |

OTHER PUBLICATIONS

Ka-band 0.18um CMOS low noise amplifier with 5.2dB noise figure Win-Ming Chang, Zi-Hao Hsiung, and Christina F. Jou Microwave and Optical Technology Letters vol. 49, No. 5, May 2007.*

"Low-Cost Transmit/Receive Module for Satellite Control and Communications," www.afrlhorizons.com/briefs/apr06/IF_H_05_22.html, last visited: Jun. 28, 2007.

* cited by examiner

DUAL BAND QUADPACK TRANSMIT/RECEIVE MODULE

BACKGROUND OF THE INVENTION

1. Technical Field

The present invention relates to radar systems. More particularly, the present invention relates to transmit/receive modules in compact packages.

2. Description of the Background Art

A variety of technical problems face one looking to equip an airplane with Ku and Ka band radars (for simplicity, K band radars are referred to with lower case letters, not the official subscripts). Modern radars systems are often implemented as active electronically scanned arrays with hundreds of transmit/receive modules aligned in an array. One advantage of an active electronically scanned array is that it can perform radar scans without physically turning the radar array. This is accomplished by altering the phase of the transmitted radars. By synchronizing the phases of each of the transmit/receive modules, the beam transmitted points in a different direction. However, in order to change the direction of the radar beam (i.e., the main lobe) the transmitted radars must be packed close enough together to work in unison.

Ka band radar, short for "K above," is transmitted at approximately 18-40 GHz. Because such high frequencies are being used, the transmit/receive modules must be packed very tightly. In an active electronically scanned array, the lattice spacing must be approximately half of the wavelength of the highest frequency used. Ka band radar requires five elements per inch. Systems operating in the X band, e.g. 10 GHz, had ten times as much area in which to place transmit/receive modules. The demanding space requirements were too small for the current size of transmit/receive modules.

In addition to the size of the modules, a designer must also contend with the size of the connections to and from modules. Prior art designs require bulky connectors connecting a module to a radiating element. Prior art designs also require a connector from the module to a manifold interconnect. The inventors discovered that current connectors did not meet the height requirements of a Ka band radar grid.

These issues are compounded where a plane needed both Ku and Ka band radars. The module must be small enough to be able to create an effective array of Ka band radar, but still make room for both Ka band radar technology and Ku band radar technology. Because these two bands are at different frequencies, they must be transmitted and received separately. At the same time, the circuitry for both must be compact enough that it can fit into the Ka space requirements.

SUMMARY OF THE INVENTION

Embodiments of the present invention provide a multi-channel, dual-band, radio frequency (RF) transmit/receive (T/R) module for an active electronically scanned array. The module includes a compact, RF manifold connector and at least four T/R channels. Each of the T/R channels includes a notch radiator, a diplexer coupled to the notch radiator, a power amplifier, including at least one dual-band gain stage, coupled to the notch radiator, a low noise amplifier, including at least one lower-band gain stage and at least one upper-band gain stage, coupled to the diplexer, and a T/R cell, including a phase shifter, a signal attenuator and at least one dual-band gain stage, coupled to the power amplifier, the low noise amplifier and the manifold connector.

BRIEF DESCRIPTION OF THE DRAWINGS

The same part of an invention appearing in more than one view of the drawing is always designated by the same reference character. Lowercase letters designate different instances of a given part.

DETAILED DESCRIPTION

Figure 1:
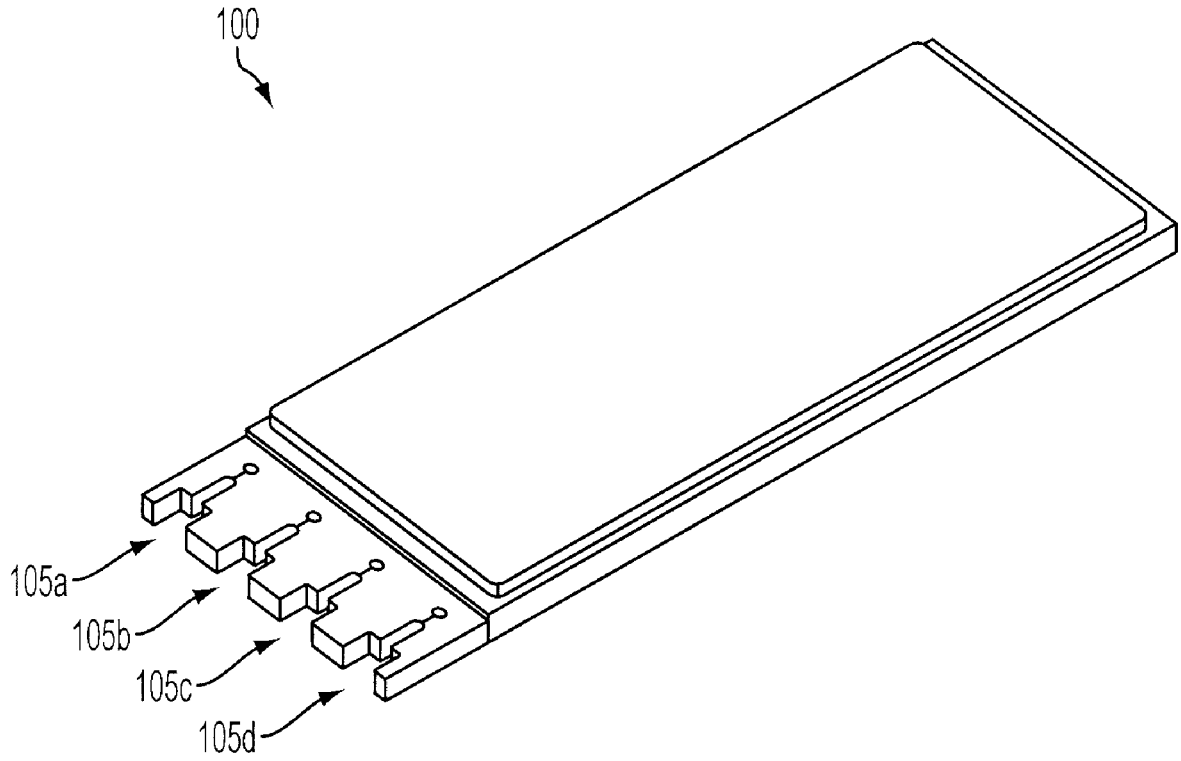
FIG. 1 is a high three quarters view of a transmit/receive module according to an embodiment of the present invention.

FIG. 1 depicts one embodiment of a transmit/receive module 100 with four integrated radiators 105. The package for the transmit/receive module 100 illustrated was designed to match the dimensions of the integrated radiators 105. The integrated radiators 105 depicted are notch radiators. The dimensions of the integrated radiators 105 are in turn governed by the spacing requirements of the Ka band radar grid, because the Ka band is the highest frequency received, and thus integrated radiators 105, a type of receiver, must be closer to each other to receive the shorter wavelength signals. Each of the four integrated radiators 105 is on a separate channel. The transmit/receive module 100 is depicted without a bulky connector because the radiating elements, i.e. integrated radiators 105, and the MMICs are all built into the package. In one embodiment, transmit/receive modules 100 similar to the one in FIG. 1 are mounted into an oval shaped array. The oval shape allows the array to be mounted into the nose of an airplane. For certain missions, it may be desirable to mount the radar array on the underside of an airplane, in which case a rectangular array may be implemented.

Figure 2:
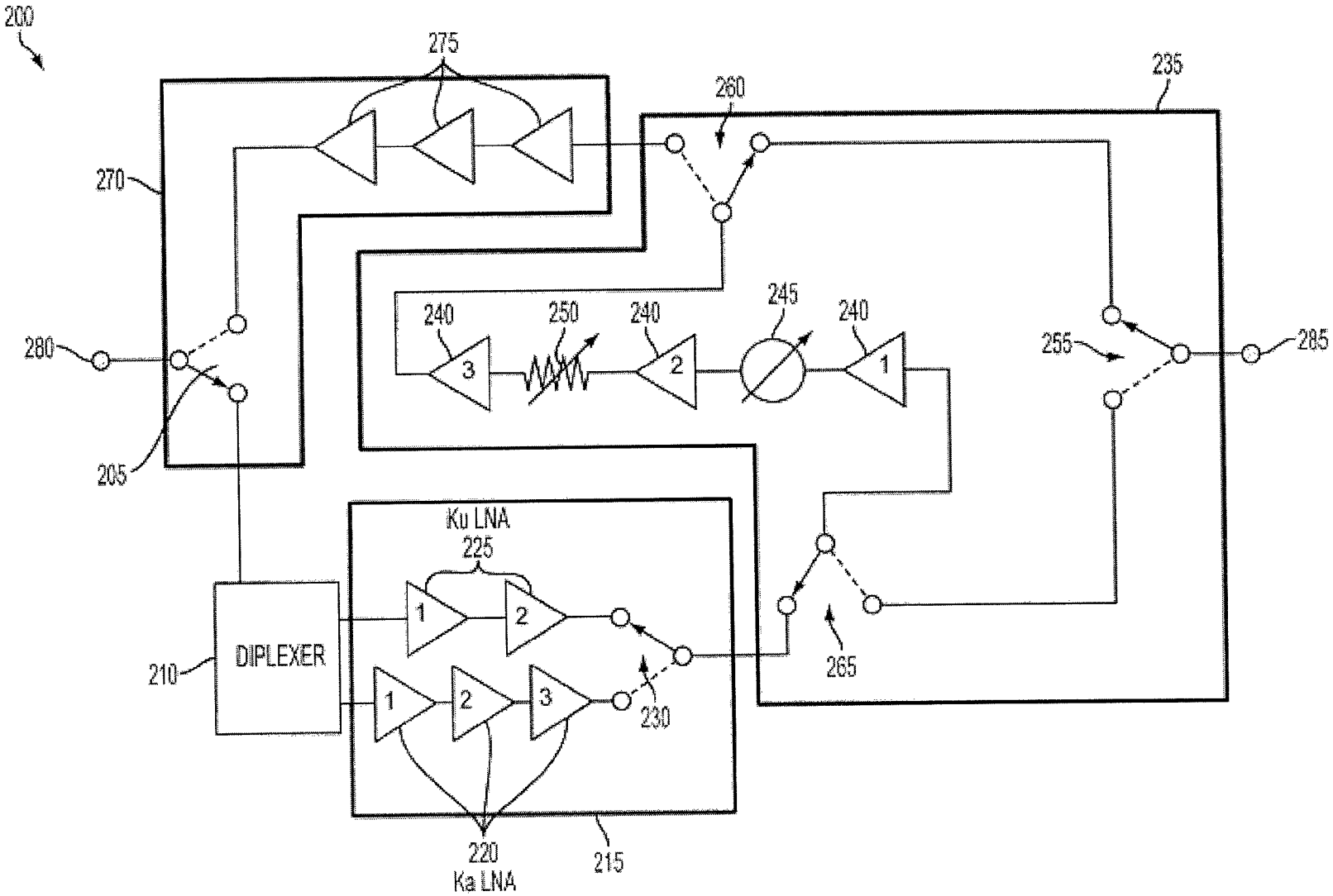
FIG. 2 is a schematic block diagram of a single transmit/receive channel according to an embodiment of the present invention.

FIG. 2 illustrates a block diagram of one embodiment of a single channel transmit and receive channel 200. The receive path begins where the T/R switch 205 connects to the integrated radiator 105 with the radiator connection 280. The T/R switch 205 is a high power switch which connects the integrated radiator 105 to either the transmit path or to the receive path. Even though the drawings depict a unidirectional arrow, signals may flow in either direction, as is required to transmit and receive. The receive path continues through the diplexer 210 to the LNAs 215. The diplexer 210 separates Ku and Ka band signals, and is described in more depth at FIG. 5A. An LNA 215 is used to amplify signals received by the integrated radiators 105, a type of antenna, because these signals are often too weak to be directly fed into other circuit components. An LNA 215 is a type of amplifier that is optimized to produce as little noise as possible while still meeting amplification requirements for the signal. The LNAs 215 illustrated have two paths of gain stages, one for Ka band signals 220 and one for Ku band signals 225. As shown, both K band receive paths have multiple gain stages within the LNAs 215. The Ka band path has an extra gain stage 220-3 because Ka is at a higher frequency than Ku, and thus the extra gain provided by a third gain stage 220-3 is justified.

The LNA 215 output flows across the LNA switch 230 to the T/R cell 235. The T/R cell 235 provides a series of gain stages 240. After the first gain stage 240-1, the signal is phase shifted by a variable shifter 245. After the second gain stage 240-2, the signal is attenuated by a variable resistance 250, sometimes implemented as a digital attenuator. The T/R cell 235 implements 5 bits of phase shift 245 and 6 bits of attenuation 250. This allows the T/R cell 235 to transmit or receive one of the four channels 200. The attenuation allows the beam steering circuitry to control the size of the transmitted signals from each transmit/receive channel 20 relative to each other channel 200. If an array is malfunctioning such that the right side lobe is too pronounced, the variable resistance 250 can be used to ensure that a smaller side lobe is produced. In other situations, fine grained attenuation may be employed to make small adjustments to the shape of a signal transmitted. The T/R cell 235 has three switches, the manifold interconnect switch 255, the transmit path switch 260 and the receive path switch 265. These three switches control the flow of signals through the T/R cell's three gain stages. The output of the third gain stage 240-3 travels across the manifold interconnect switch 255 and the transmit path switch 260 to the manifold interconnect 240.

The transmit path begins at the T/R cell 235. The T/R cell 235 performs the same function on transmitted signals as it does on received signals. When the manifold interconnect switch 255 is set to the transmit path, the signal will flow across from the manifold connection 285 to the receive path switch 265 to the three gain stages 240. After being shifted and attenuated, the signal exits the T/R cell 235 via the transmit path switch 260 and continues to the power amplifier 270. Conversely, the receive path flows as described above. The signal travels from the LNAs 215 to the receive path switch 265, across the three gain stages 240, to the transmit path switch 260 and then to the manifold interconnect switch 255.

The T/R cell 235 outputs to the power amplifier 270. The power amplifier 270 has three gain stages 275 to ensure that the transmitted signal has the requisite signal strength. The power amplifier 270 outputs to the T/R switch 205, where it is routed to the radiator 105. In a preferred embodiment, the power amplifier 270, like the T/R switch 205, is designed to work at both the Ka and Ku bands. When the T/R switch 205 is integrated with the power amplifier 270, it may be referred to as a power amplifier switch 205.

Figure 3:
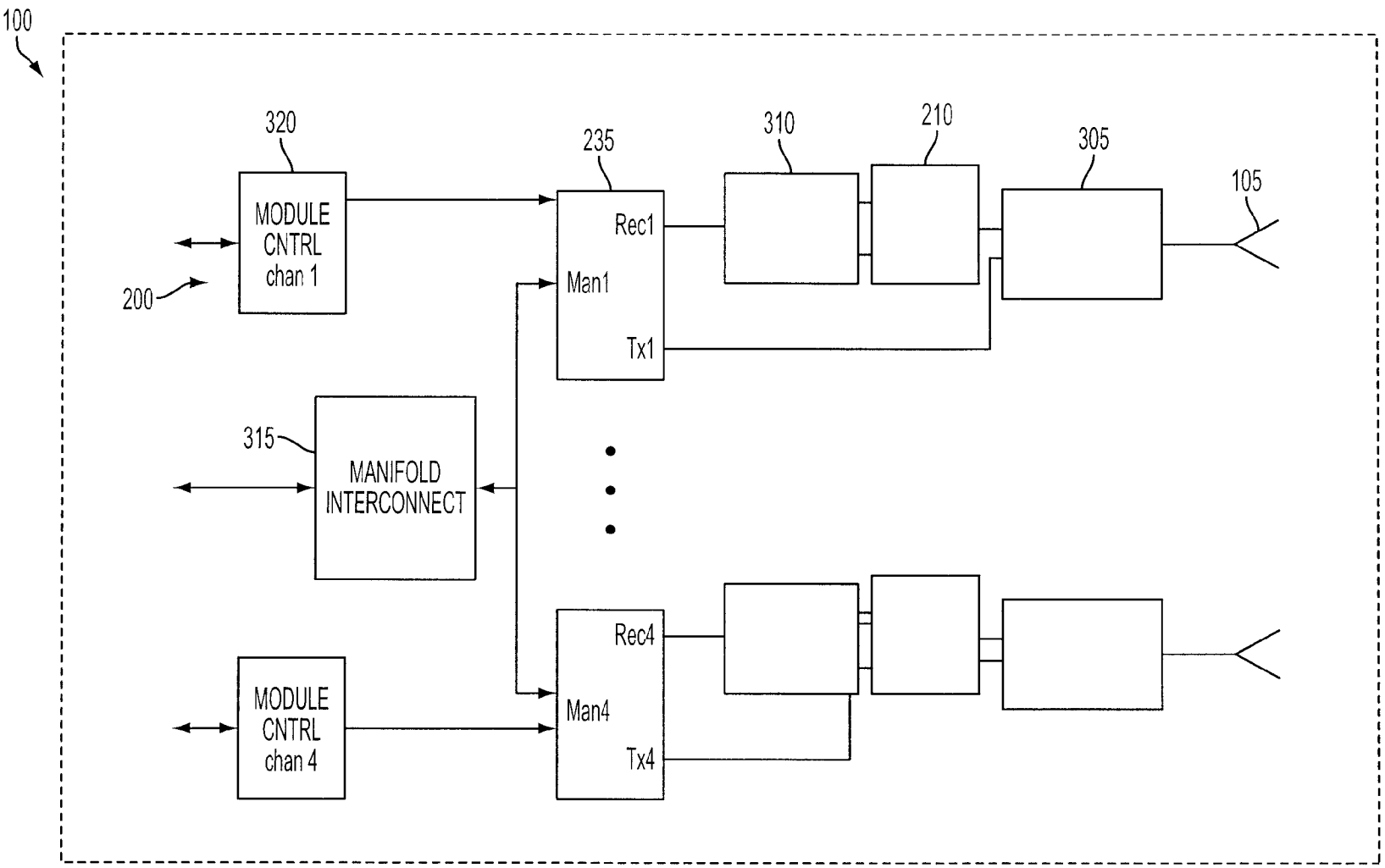
FIG. 3 is a schematic module level block diagram of a four channel transmit/receive module according to an embodiment of the present invention.

FIG. 3 depicts a module level block diagram of one embodiment of the T/R module 100. There are four radiators 105, each corresponding to a channel 1-4 205. The receive path begins at a given radiator 105 and continues to a power amplification MMIC 305. The power amplification MMIC 305 has an integrated T/R switch 205 and power amplifier 270. In a preferred embodiment, all of the power amplifier MMICs 305 in a transmit/receive module share a single gate regulator ASIC 405 (depicted in FIG. 4). The power amplification MMIC 305 routes the receive path to the diplexer 210. The diplexer 210 feeds the Ka band components to the Ka band gain stages 240 in the LNAs 215 and feeds the Ku band components to the Ku band gain stages 245 in the LNAs 215. The Ka band gain stages 240, the Ku band gain stages 245 and the LNA switch 230 are all housed in a LNA MMIC 310. The LNA MMIC 310 connects to a T/R cell 235.

The path used to transmit a signal has a number of components in common with the receive path. A signal to be transmitted is provided by the manifold interconnect 315, and is routed to the T/R cell 235. The T/R cell 235 directs the signal to the T/R switch 205, which routes the signal to the radiator 105. The transmit path does not use the LNAs 215 or the diplexer 210. By avoiding these band specific devices, the transmit path is identical for both the Ka and Ku bands. Therefore, it may be possible to transmit in both bands at one time.

The receive and transmit paths converge at the T/R cell 235, preferably embodied as a SAD MMIC. The T/R cell 235 interfaces with the manifold interconnect 315 and receives control signals for its channel 200. The control signals allow the T/R cell 235 to either route signals from the manifold 315 to the transmit path or from the receive path to the manifold interconnect 315. Like the power amplifier 270, the T/R cell 235 is a dual band device.

Figure 4:
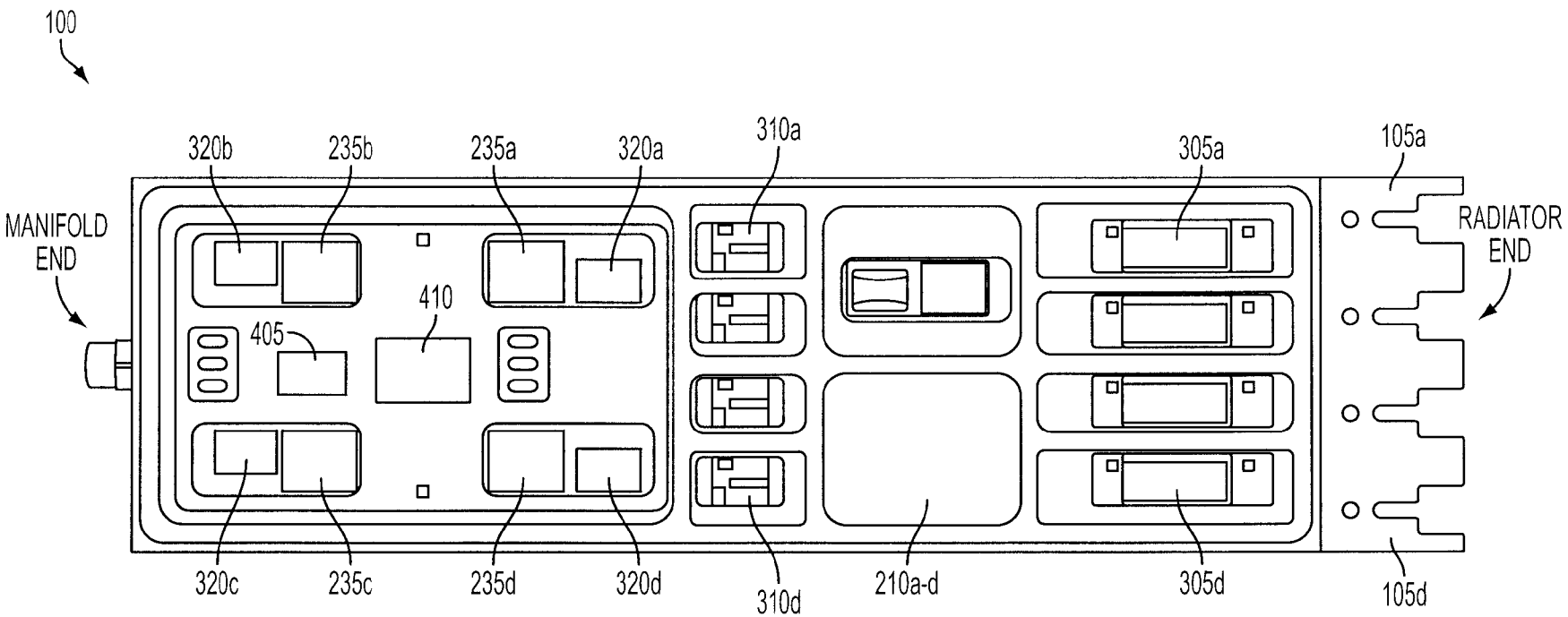
FIG. 4 is an overhead cutaway view of a four channel transmit/receive module according to an embodiment of the present invention.

All of the MMICs in a transmit/receive module 100, such as the SAD MMIC 235, the LNA MMIC 310 and the power amplifier MMIC 305, share a drain regulator ASIC 410 (depicted in FIG. 4).

The control signals are provided to the T/R cell 235 by the control module 320 for each channel 200. The control module 320 may be implemented as an ASIC. The control module 320 receives six bidirectional DC signals which are used to generate control signals for the T/R cell 235, the LNA switches 230 and the T/R switch 205. An ASIC control module is a type of control chip.

The control signals allow the T/R cell 235 to interface with beam steering circuitry (not shown). Beam steering refers to changing the main lobe of radar signal. This allows a stationary radar array to point in different directions, often in a sweeping pattern. In certain instances, beam steering circuitry may be employed to enlarge or reduce side lobes of a transmitted signal. Beam steering and lobe adjustment may be accomplished by altering three variables: which transmit/receive modules 100 are addressed; the phase of signals transmitted; and the attenuation of the signals transmitted. Digital signal processors (not shown) are often employed to calculate the particular control signals needed to direct various lobes. A beam steering controller (not shown) includes a memory module, a controller CPU module, an interface timing module, a beam computation module and array interface module.

In a preferred embodiment, a manifold interconnect 315 is connected to the T/R cells 235 with an RF network which delivers signals from the manifold interconnect 315 to the T/R cells 235 and transports received signals back to the manifold interconnect 315. The RF network, part of the manifold interconnect 315, is an example of a manifold connection.

FIG. 3 illustrates a layout of one embodiment of a transmit/receive module 100. This embodiment is referred to as a "quadpack," because it provides four channels in a single package. Other embodiments may have eight channels, or another multiple of four channels. Exemplary MMICs have been manufactured by Triquint Semiconductor using pHEMT technology on a state of the art processes. pHEMT stands for pseudomorphic High Electron Mobility Transistor. An HEMT is a transistor where, instead of an n-doped region, there is a junction between two materials with different band gaps. This junction creates a thin layer where the Fermi energy is greater than the energy of the conduction band. This provides for high electron mobility. Pseudomorphism refers, in this case, to stretching a thin layer of a first material over the second. By covering one of the two materials, the junction interfaces with two identical lattice constants. The covered material, however, is not required to have an identical lattice structure, and this allows for a bigger band gap than two materials that have identical lattice constants. The larger band gap provides for improved performance.

MMICs are generally manufactured from Gallium Arsenide, Indium Phosphate or Silicon Germanium, so that the devices can operate at the required frequencies. One element of a compact design may be manufacturing a three metal interconnect MMIC from Gallium Arsenide.

The placement of the power amplifier 270 is important for transmission, and the switch 205 is integrated with the power amplifier 270 to save space. In a preferred embodiment, a high power T/R switch 205 is used instead of a circulator because traditional circulators may be too large to fit inside of the power amplifier cavity. Power amplifiers 270 have lower linear response requirements than the LNAs 215. The T/R switch 205 is placed on the front end of the power amplifier MMIC 305 closest to the integrated radiators 105, and is built into a power amplifier 270 and located in the power amplifier cavity. Each power amplifier 270 and T/R switch 205 is placed directly behind its respective integrated radiator 105, so that the power amplifier 215 is as close to the integrated radiator 105 as possible. One advantage of placing the power amplifier 270 directly before the integrated radiator 105 is that any potential interference or attenuation is minimized. This helps to ensure that the transmitted signal is not changed before being transmitted.

The diplexers 210 are placed in a cavity between the power amplifier cavities and the LNA cavities. Unlike some of the other devices, the diplexers 210 are not placed in line with their respective transmit and receive channels 200. The MMICs are each separate integrated circuits, whereas the diplexers 210 are, in large part, stripline RF traces embedded in ceramic, a type of ceramic insulation.

The LNAs 215 are placed directly after the diplexers 210 to be as close together as possible. LNAs 215 are most effective if used close to the integrated radiators 105 because the less there is between the integrated radatior 105 and the LNAs 215, the less possibility there is for noise to be introduced. Noise that is introduced before the LNA 215 may be indistinguishable from the signal, particularly if it is at the same frequency. That is, if the noise is within the band that the LNA 215 is designed to amplify, then the noise will be amplified as though it were the signal. Conversely, if this same noise is added to the signal after the LNA 215, it will be attenuated relative to the signal and thus have a reduced effect on system input. By placing the LNA 215 physically close to the diplexer 210, feedline losses are reduced.

After the LNAs 215, there are four pairs of T/R cells 235 and control module 320 ASICs, and each pair is placed in a corner. This placement allows space for the gate regulator ASICs 405 and drain regulator ASICs 410 and for the manifold interconnect 315 to be symmetrically routed to each T/R cell 235.

Because the Ka grid may force tight spacing requirements, a number of techniques may be employed to route signals within one embodiment of the module. In order to obtain the benefits of a four-channel architecture, one embodiment of the transmit/receive module 100 utilizes minimum spacing tolerances between all RF and DC lines in most areas of the package layout. The use of thin dielectric tape layers allows for stripline 530, discussed in more depth in FIG. 5A, with minimum ground spacing. For example, LTCC tape is sold in thicknesses of 10 mils, but may be cut to 5 mils or less. Smaller ground spacing leads to smaller conductor widths for 50 ohm traces. The thin layers of stripline 530 also allow for multiple layers of high current carrying voltage to be successfully routed in the tight height restrictions.

Double rows of grounding vias 535 may be used on both sides of the stripline 545 to keep Ka signals from leaking through to other transmit and receive channels 200. This dense placement of grounding vias 535 improves the problem of Ka leakage. New techniques in LTCC fabrication such as placing fewer transmit/receive modules 100 on each LTCC panel to reduce shrinkage of the LTCC have been developed to counter the effects of increased via 510 count.

Received signals enter the module 100 through one of four integrated notch radiators 105. A transmit/receive module 100 may have one integrated radiator 105 for each of the four channels 200, where the term integrated radiator 105 commonly refers to a radiator 105 without a bulky connector attaching the transmit/receive module 100 to a separate radiator or antenna. The desire for both Ka and Ku band radar may prompt some designers to implement integrated radiators 105 that are wideband.

In one embodiment, an integrated radiator 105, such as a wideband notch radiator, couples a stripline 530, often 50 ohms, with the air, usually 376 ohms, such that a signal may be fed into the stripline 530 and may pass through to the radiating medium with minimal interference. The notch is an aperture cut to form an integrated radiator 105 with a load that matches the ambient radiating medium. The aperture is cut from a dielectric substrate, which also houses the stripline 530. The substrate sandwiches the stripline 530 and provides insulation. The stripline 530 is connected to the notch with a feed end, and both connecting ends are generally a quarter wavelength long, or a multiple thereof. The integrated radiator 105 is designed for wideband operation using low-temperature co-fired ceramic (LTCC), such as Dupont 943 LTCC. In one embodiment, the stripline feed 505 connects to the power amplifier cavity.

In one embodiment, a manifold interconnect 315 may be comprised of a plurality of contiguous RF stripline microwave conductor board members, an example of stripline 530, which are mutually insulated from one another and include RF coupler sections which abut a pair of relatively shorter tubular coupler members, and which are also adapted to couple transmit RF and receive RF to and from a transmit/receive module 100. The single connection may provide four channels 200 which are received by a ceramic locus splitter.

Figure 5A:
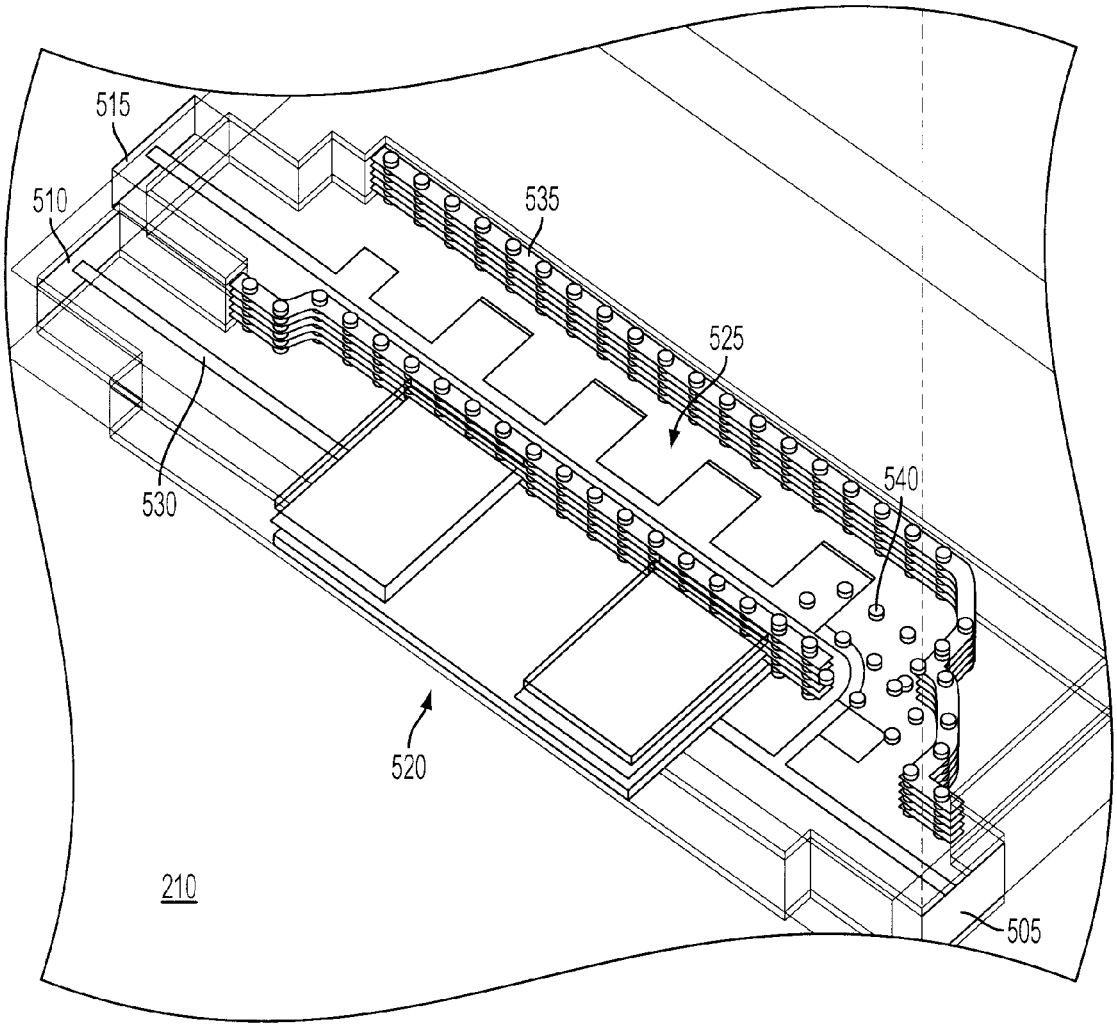
FIG. 5A is a phantom view of a Ka/Ku band diplexer according to an embodiment of the present invention.

FIG. 5A depicts a layout view of a diplexer 210 according to a preferred embodiment. In this embodiment, each diplexer 210 is approximately 0.28×0.16×0.03 (L×W×H, in inches). A diplexer 210 is a single element which can receive input signals at multiple discrete frequency ranges. The diplexer 210 is connected to three ports. Port 1 505 provides a Ku and Ka band signal from the integrated radiator 105. This signal is divided into Ku band frequencies, which are delivered to Port 2 510, and Ka band frequencies, which are delivered to Port 3 515. The Ka band signals are filtered with a rectangular waveguide 520. This rectangular waveguide 520 provides a cutoff frequency of 28 GHz, and is preferably dielectric filled. The Ku band signals are filtered by a low pass filter 525. The stripline 530 forms passive elements to create a low pass filter 525 with a cutoff frequency of 20 GHz. Stripline 530 is also known as RF trace.

Grounding walls 535 are placed on both sides of the Ku band signal path to provide isolation from other signals. The Ku band signal path is more sensitive to unwanted signals than the Ka band path because the Ku path contains passive components, such as a low pass filter 525. The rectangular waveguide 520 of the Ka path is shielded. The grounding walls 535 are between two ground planes, one above the diplexer and one below. The grounding walls 535 are formed with a series of grounding vias 540 between the ground planes. Unwanted signals from outside the diplexer 210 encounter the ground planes or the grounding vias 540 and are absorbed into the ground plane rather than interfering with the signals passing through the diplexer 210.

In an embodiment where the diplexer 210 performs a transmit function in addition to receiving, added isolation between Port 2 510 and Port 3 515 may be needed, because these transmitted signals represent noise to the other band. This is less of a concern when receiving because the received signals are amplified after the diplexer 210, whereas the transmitted signals are amplified and then sent to the diplexer 210.

Ceramics may be used to insulate against unwanted signals as well as grounding techniques. Interface issues between Ku energy operating in a Ka band environment can be solved, in part, by embedding the diplexer 210 in ceramics.

Figure 5B:
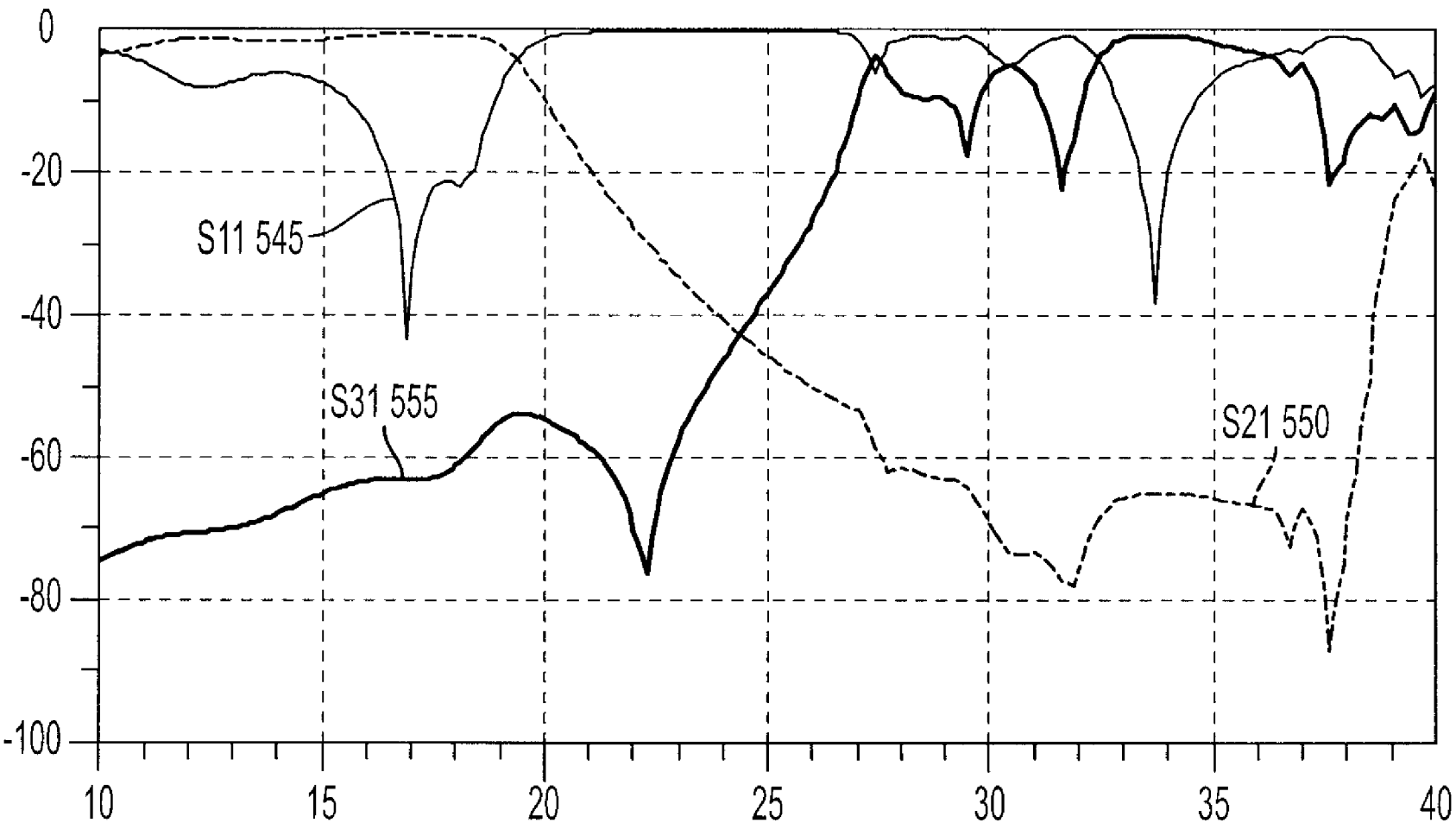
FIG. 5B is a reproduction of simulated diplexer results according to an embodiment of the present invention.

FIG. 5B depicts simulated results of the diplexer shown in FIG. 5A. The simulation was performed using HFSS™ from Ansoft, a 3D electromagnetic field simulation tool, and depicts S-parameter simulation results. S11 545 is the signal measured at Port 1 505 based on an input at Port 1 505. This represents a frequency sweep received by the integrated radiator 105 and transmitted to the diplexer 210. S21 550 is the signal measured at Port 2 510 based on the input frequency sweep. It illustrates that frequencies up to 20 GHz are filtered with less than approximately 10 dB of attenuation. As frequencies rise past 20 GHz, the low pass filter 525 provides ever greater attenuation. Many Ka band frequencies will be attenuated by more than 60 dB. S31 555 is the signal measured at Port 3 515, the Ka band portion of the signal received by the integrated radiator 105. As frequencies approach 28 GHz, the attenuation of the Ka band rectangular waveguide 520 drops off.

Figure 6:
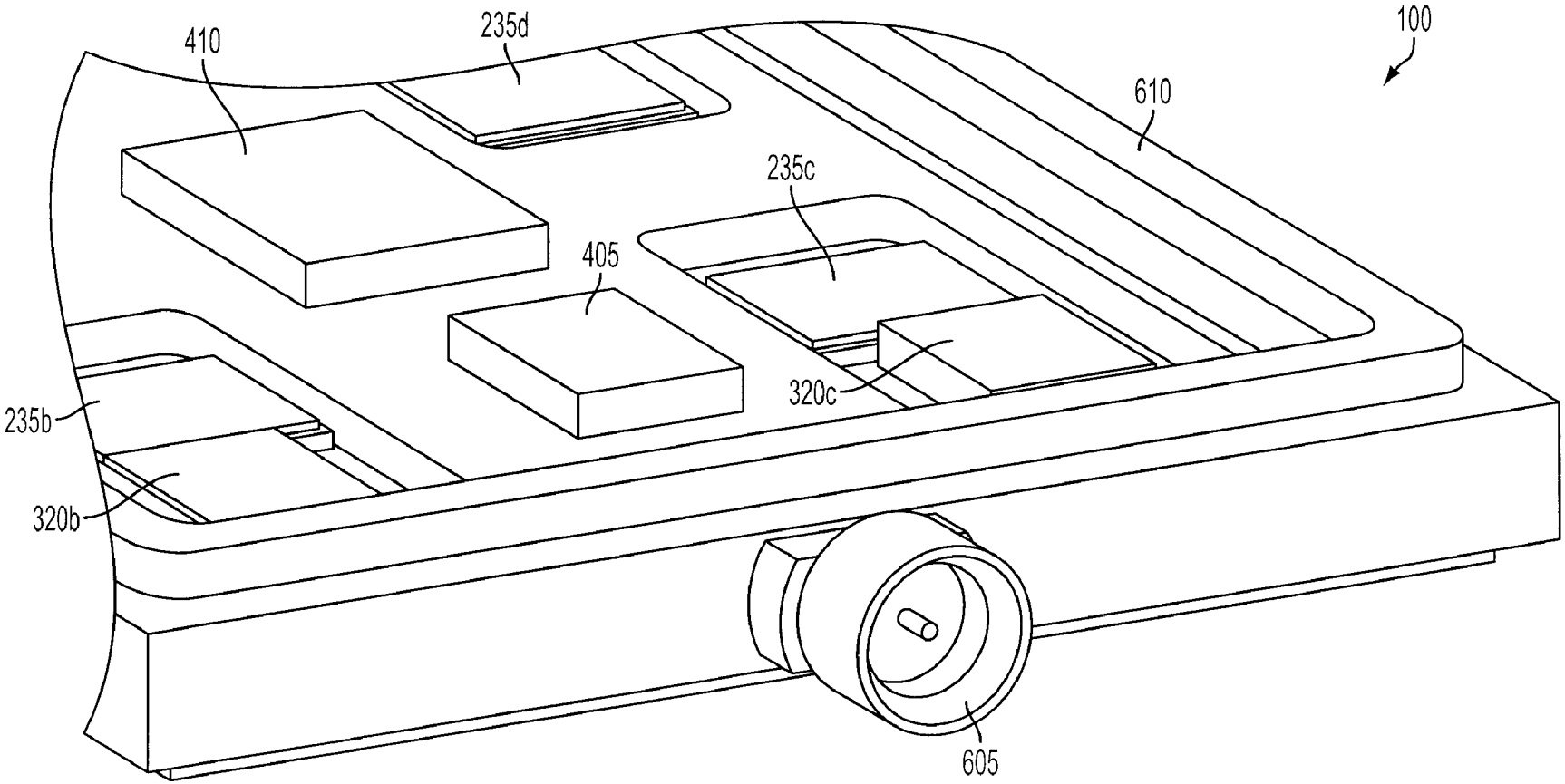
FIG. 6 is an isometric view of a compact connector according to an embodiment of the present invention.

FIG. 6 illustrates a one embodiment of the invention comprising a compact connector 605 and an outer ring 610. This connector 605 provides a single output from the transmit/receive module 100 to a radar system. The connection between the two should not be higher than the height of the transmit/receive module 100. In one embodiment, a blind-mate microwave connector, such as those supplied by the Gore corporation, may be modified to provide a compact connector. For example, a Gore 60 g connector (part of Gore's 100 Series of connectors) is 0.095" across but the ceramic height is less than 0.078". The 60g connector may be modified to reduce the height of its mating surface and increase the width of the mating surface, to ensure that a minimum of 0.004 square inches of solder area is provided. This modification may be performed by cutting, filing or shaving the connector. The modified Gore brand connector 605 can then be attached to the mating area with enough solder to physically support the connection. References to the Gore brand are for clarity, connectors from other suppliers may be substituted.

Figure 7:
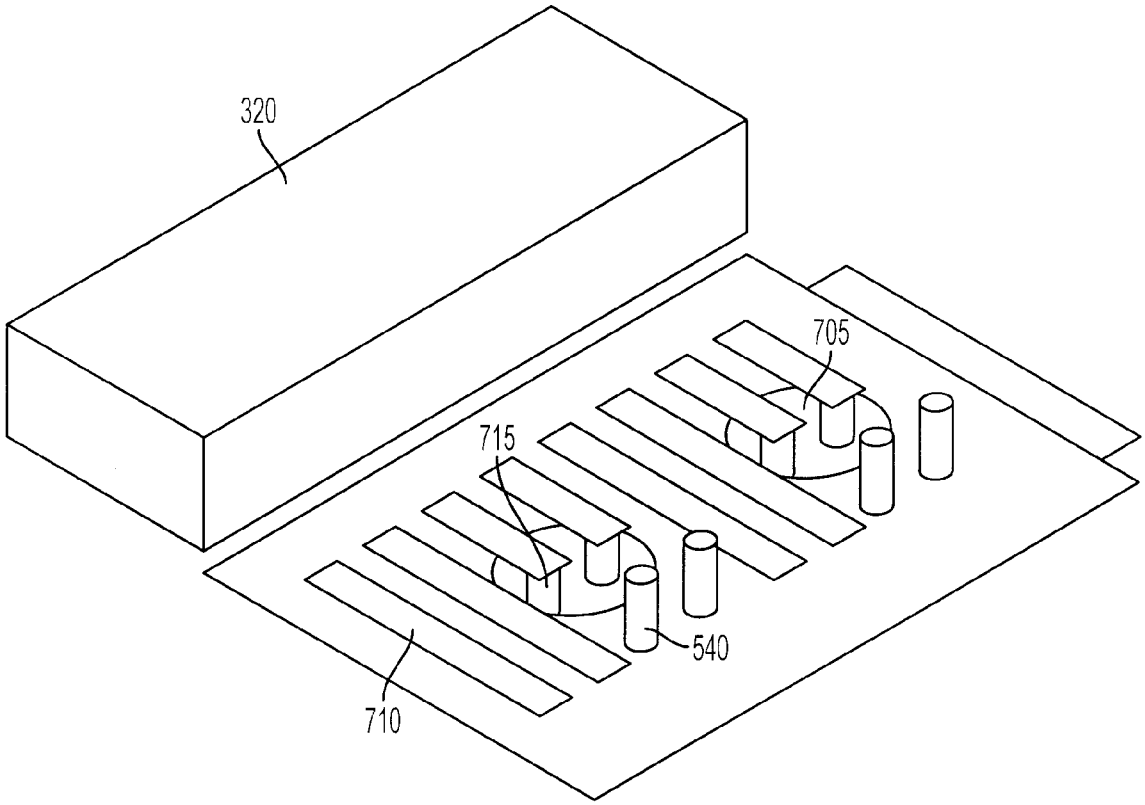
FIG. 7 is an isometric view of a DC routing technique according to an embodiment of the present invention.

FIG. 7 depicts routing of signals through "swiss-cheese" openings 705 on a printed wiring board, according to one embodiment. In certain radar applications all DC traces 710 are routed out through a single large opening. In one embodiment of the present invention, DC is routed out through a series of smaller, swiss-cheese openings 705 to reduce cavity resonance. Cavity resonance is, in part, a function of the length of the cavity dimensions. By employing a series of smaller cavities, such as swiss-cheese openings 705, the peak resonance is reduced, because it is effectively spread between a variety of different cavities. The resonant frequencies produced are, in part, a function of the shape of the cavity. In a preferred embodiment, the swiss-cheese openings 705 may be circular.

The DC traces 710 are paired, for balance, and then routed out through the floor of the cavity and then through the wall of the cavity one pair at a time. As depicted, the DC traces 710 are routed through the cavity with vias 715. The vias 715 are about 5 mils in diameter. On the far side of the cavity, grounding vias 540 are placed that connect to the ground plane, as shown. The use of a pair of grounding vias 540 helps insulate cavity resonance.

The DC traces 710 originate from a data bus. Each of the channels 200 has a separate data bus. Each data bus has a control module 320, such as a module channel controller, often implemented as an ASIC. In one embodiment, each control chip is separately addressable across the manifold interconnect 315.

Figure 8:
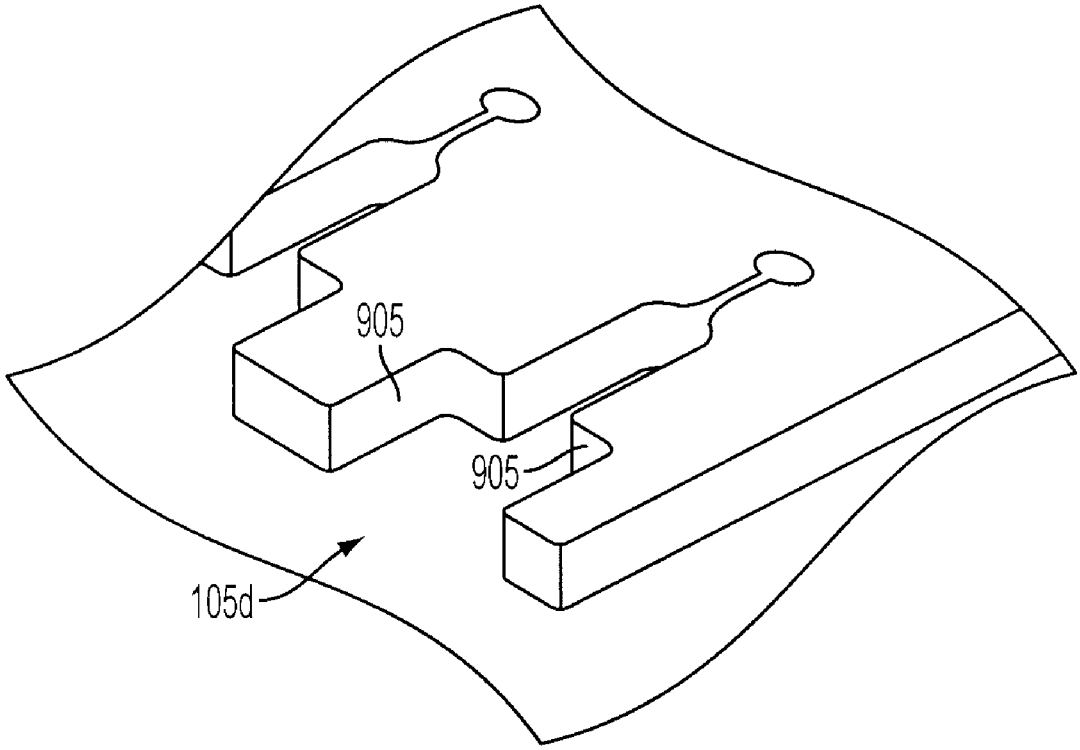
FIG. 8 is a close up view of a notched radiator according to an embodiment of the present invention.

FIG. 8 depicts a close up view of an notched radiator 105. The transmitted signal travels between the walls 905.

While this invention has been described in conjunction with specific embodiments thereof, many alternatives, modifications and variations will be apparent to those skilled in the art. Accordingly, the preferred embodiments of the invention as set forth herein, are intended to be illustrative, not limiting. Various changes may be made without departing from the true spirit and full scope of the invention as set forth herein.

We claim:

1. A multi-channel, dual-band, radio frequency (RF) transmit/receive (T/R) module, comprising:

a compact, RF manifold connector; and at least four T/R channels, each including:

a notch radiator, a diplexer with an input port coupled to the notch radiator, an upper-band port and a lower-band port, a power amplifier, including at least one dual-band gain stage, coupled to the notch radiator, a low noise amplifier, including n lower-band gain stages arranged in series and coupled to the lower-band port of the diplexer and m upper-band gain stages arranged in series and coupled to the upper-band port of the diplexer, where m is greater than n, and a T/R cell, including a phase shifter, a signal attenuator and at least one dual-band gain stage, coupled to the power amplifier, the low noise amplifier and the manifold connector.

2. The T/R module of claim 1, wherein the lower-band is Ku-band and the upper-band is Ka-band.

3. The T/R module of claim 2, wherein the diplexer is approximately 0.28 inches in length, 0.16 inches in width and 0.03 inches in height.

4. The T/R module of claim 2, wherein the diplexer includes:

an input port coupled to the notch radiator;

a Ku-band output port coupled to the lower-band gain stage of the low noise amplifier; and a Ka-band output port coupled to the upper-band gain stage of the low noise amplifier.

5. The T/R module of claim 4, wherein the diplexer includes a low-pass filter coupled to the input port and the Ku-band output port, and a high-pass filter coupled to the input port and the Ka-band output port.

6. The T/R module of claim 5, wherein the low-pass filter is a rectangular waveguide and the high-pass filter is a stripline waveguide.

7. The T/R module of claim 5, wherein the low-pass filter and the high-pass filter are separated by grounding walls that include ground plane vias.

8. The T/R module of claim 5, wherein the low-pass filter has a cutoff frequency of approximately 20 GHz, and the high-pass filter has a cutoff frequency of approximately 28 GHz.

9. The T/R module of claim 2, wherein the power amplifier dual-band gain stage includes at least one lower-band gain stage and at least one upper-band gain stage.

10. The T/R module of claim 9, wherein the T/R cell dual-band gain stage includes at least one lower-band gain stage and at least one upper-band gain stage.

11. The T/R module of claim 1, wherein the power amplifier includes high electron mobility transistors or pseudomorphic high electron mobility transistors.

12. The T/R module of claim 11, wherein the low noise amplifier includes high electron mobility transistors or pseudomorphic high electron mobility transistors.

13. The T/R module of claim 2, wherein the T/R channels are configured to transmit Ka and Ku band signals simultaneously.

14. An active electronically scanned array, comprising:

a beam steering computer;

a manifold coupled to the beam steering computer; and a plurality of multi-channel, dual-band, radio frequency (RF) transmit/receive (T/R) modules, coupled to the manifold and arranged in a two-dimensional array, each module including:

a compact, RF manifold connector; and at least four T/R channels, each channel including:

a notch radiator, a diplexer, including an input port coupled to the notch radiator, a Ku-band output port coupled to a lower-band gain stage of a low noise amplifier with n gain stages arranged in series, a Ka-band output port coupled to a upper-band gain stage of the low noise amplifier with m gain stages arranged in series, where m is greater than n, a low-pass filter coupled to the input port and the Ku-band output port, and a high-pass filter coupled to the input port and the Ka-band output port, a power amplifier, coupled to the notch radiator, including at least one Ku/Ka band gain stage, a low noise amplifier, including at least one Ku-band gain stage and at least one Ka-band gain stage, coupled to the diplexer, and a T/R cell, including a phase shifter, a signal attenuator and at least one Ku/Ka-band gain stage, coupled to the power amplifier, the low noise amplifier and the manifold connector.

15. The array of claim 14, wherein the low-pass filter is a rectangular waveguide, the high-pass filter is a stripline waveguide and the low-pass and high-pass filters are separated by grounding walls that include ground plane vias.

16. The array of claim 14, wherein the low-pass filter has a cutoff frequency of approximately 20 GHz, and the high-pass filter has a cutoff frequency of approximately 28 GHz.

17. The array of claim 14, wherein the power and low noise amplifiers include high electron mobility transistors or pseudomorphic high electron mobility transistors.

18. The array of claim 14, wherein the T/R channels are configured to transmit Ka and Ku band signals simultaneously.

19. The T/R module of claim 1, wherein there are two lower-band gain stages and three upper-band gain stages.

20. The T/R module of claim 1, wherein the compact, RF manifold connector is no higher than the height of the T/R module.

21. The active electronically scanned array of claim 14, wherein there are two lower-band gain stages and three upper-band gain stages.

22. The active electronically scanned array of claim 14, wherein the compact, RF manifold connector is no higher than the height of the T/R module.

* * * * *